US005474655A

United States Patent [19]

Schulte et al.

[11] Patent Number: 5,474,655

[45] Date of Patent: Dec. 12, 1995

[54] PROCESS FOR CONTROLLING THE DEPOSITION OF STICKIES FROM PAPER STOCK SUSPENSIONS

[75] Inventors: Heinz-Guenther Schulte, Muelheim; Klaus Hornfeck, Mettmann; Dieter Kaps, Simmerath, all of Germany

[73] Assignee: Henkel Kommanditgesellschaft auf Aktien, Duesseldorf, Germany

[21] Appl. No.: 374,400

[22] Filed: Jan. 17, 1995

Related U.S. Application Data

[63] Continuation of Ser. No. 86,220, Jul. 1, 1993, abandoned.

[30] Foreign Application Priority Data

Apr. 8, 1993 [DE] Germany ..... 43 11 598.5

[51] Int. Cl.[6] ..... D21H 21/02

[52] U.S. Cl. ..... 162/175; 162/177; 162/199; 162/DIG. 9

[58] Field of Search ..... 162/147, 189, 162/175, 177, 199, DIG. 9

[56] References Cited

U.S. PATENT DOCUMENTS

| | | | |
|---|---|---|---|
| 3,081,219 | 3/1963 | Drennen et al. | 162/72 |
| 4,744,865 | 5/1988 | Dreisbach et al. | 162/168 |
| 4,781,794 | 11/1988 | Moreland | 162/199 |
| 4,871,424 | 10/1989 | Dreisbach et al. | 162/168 |
| 4,923,566 | 5/1990 | Shawki et al. | 162/135 |
| 4,940,514 | 7/1990 | Stange et al. | 162/175 |

OTHER PUBLICATIONS

H. L. Baumgarten, Das Papier, 1984, 38, Heft 10A, pp. V121–V125.

J. Weigl et al., Das Papier, 1986, pp. V52–V62.

Wochenblatt für Papierfabrikation, 1993, pp. 163–170.

B. Brattka, Wochenblatt für Papierfabrikation, 1990, pp. 310–313.

Eur., Comm. Eur. Communities 14011, 1992, pp. 235–243.

*Primary Examiner*—Peter Chin

*Attorney, Agent, or Firm*—Ernest G. Szoke; Wayne C. Jaeschke; Real J. Grandmaison

[57] ABSTRACT

The invention relates to a process for controlling the deposition of stickies from paper stock suspensions in papermaking. According to the invention, the deposition of stickies is controlled by addition of an effective quantity of a degradation product of native starch to the paper stock suspension.

14 Claims, No Drawings

PROCESS FOR CONTROLLING THE DEPOSITION OF STICKIES FROM PAPER STOCK SUSPENSIONS

This application is a continuation of application Ser. No. 08/086,220 filed on Jul. 1, 1993 now abandoned.

BACKGROUND OF THE INVENTION

1. Field of the Invention

This invention relates to a process for controlling the deposition of stickies from paper stock suspensions in papermaking.

2. Discussion of Related Art

Even though paper was invented in the second century, the use of waste material, i.e. the technique of— at least partial—recycling, played a certain part. In today's world, considerable significance is attributed to recycling technology because of the increase in ecological awareness. Accordingly, questions of raw materials supply and the avoidance of waste are becoming increasingly important in the steadily increasing production of paper.

By using secondary fibers through the recycling of waste paper, savings can be now be made in regard to raw materials, waste disposal space and the energy involved in papermaking. However, this technology is attended by specific difficulties.

Thus, in the processing of wastepaper, tacky impurities known as stickies can seriously disrupt the production process and adversely affect the quality of the paper produced. Stickies enter the papermaking process when the wastepaper used contains glued bindings, adhesive tape or specially treated products, such as coated, laminated or coated papers or paperboards. In addition, however, stickies can be formed by the rosin in wood and by its interaction with paper auxiliaries.

If the stickies are present in compact form, they can be chemically removed relatively easily by means of sorting machines. In general, however, the stickies are present not only in compact form, but also in dispersed form in the pulp and are very difficult to remove in this form. Accordingly, the increasing use of wastepaper in papermaking and the reduction in size of the water circuits has increasingly resulted in an increase in the percentage content of stickies in the circuit water.

Stickies cause numerous problems and disruptions not only in the manufacture of paper, but also in the processing of paper. On account of their tackiness, deposits are formed on machine parts, pipe walls, wires, wet felts, dry felts, drying cylinders, smoothing rollers, calender rollers and also in the finished paper, resulting in web breaks in the papermaking machine and in a deterioration in paper quality through holes, specks, marks, etc. (cf. H. L. Baumgarten, Das Papier, 1984, 38, No. 10A, pages V121–V125). According to H. L. Baumgarten, stickies in industrial and institutional publications have for years been regarded as the biggest problem of reusing wastepaper. Even minimal quantities of adhesive can cause breaks in papermaking and printing machines so that stoppages for cleaning are unavoidable. Baumgarten says that "2 g adhesive introduced at an appropriate point of the papermaking machine can result in the rejection of several hundred kg paper" (loc. cit. page V122, right-hand column).

Stickies do not come from a single source. For the most part, they emanate from the rosin in wood, paper-making auxiliaries, binders for the coating of paper and paperboard, paper processing adhesives, printing ink binders and paper processing materials. Of particular importance in the context of the problem addressed by the present invention are the stickies which emanate from the rosin in wood and from the adhesives used in paper processing.

The rosins present in chemical pulp and mechanical pulp contain approximately 1 to 5% by weight so-called harmful resins, depending on the type wood. These resins may be present in colloidally non-bound form or may adhere to the paper fibers. According to J. Weigl et al., the difficulties caused by rosin deposits in the manufacture and processing of paper have steadily increased over recent years for various reasons (cf. J. Weigl et al., Das Papier, 1986, pages V52–V62; more particularly page V53, left-hand column).

The adhesives used in the processing of paper can be divided into three groups, namely: pressure-sensitive adhesives, dispersion adhesives and hotmelt adhesives.

The pressure-sensitive adhesives are permanently tacky products. In their case, adhesion is achieved by application of pressure to the surfaces of the substrates to be bonded. The basic polymers typically used are selected from a number of basic substances in combination with corresponding additives, for example tackifying resins, plasticizers or antioxidants. Typical basic polymers are inter alia natural rubber, butyl rubber, styrene/butadiene copolymers (SBR rubber), acrylonitrile copolymers, polychloroprene, polyisobutylene, polyvinyl ether, acrylates, polyesters, polyurethanes, silicones.

In dispersion adhesives, the polymers used to form the adhesive layer are present as solid particles in an aqueous dispersion medium. In the production process, the basic monomers are first emulsified in an aqueous phase and then polymerized therein—a technique known as emulsion polymerization. The polymer is then present in the form of small particles with different particle sizes which may vary from molecularly disperse to coarsely disperse. In general, agglomeration and, hence, sedimentation of the polymer particles is counteracted by addition of protective colloids or emulsifiers to the system.

So-called hotmelt adhesives or "hotmelts" belong to the group of thermoplastics. Thermoplastics soften on heating and become fluid. On cooling, they solidify again. Examples of polymers used as hotmelt adhesives are polyamides, copolyamides, polyaminoamines, saturated polyesters and ethylene/vinyl acetate copolymers.

Stickies are divided into primary stickies and secondary stickies. Primary stickies are stickies which are not dispersed on account of their high resistance to wet size reduction. Accordingly, they are present in compact form and are easy to remove.

The existence of secondary stickies is attributable to the fact that, in the recovery of wastepaper, the stickies undergo a change in particle size which is brought about by thermal, chemical and mechanical influences. This means that even impurities which are still present in extremely coarse form at the beginning of the recovery process can undergo a more or less considerable reduction in size during the recovery of wastepaper. More particularly, stickies are dispersed by the operations taking place in the hot kneader used for wastepaper recovery. For example, stickies of low melting point are liquefied and then very finely dispersed. Friable or fragile stickies also break up into very small particles. The particle size of the dispersed stickies then extends from coarsely disperse via colloidally disperse to molecularly disperse.

In other words, many stickies are readily dispersible with the result that, after dissolution, they are present in finely divided form and are not picked up in the sorting process. These substances are in danger of forming agglomerates known as secondary stickies in the papermaking machine through thermal, mechanical or chemical influences. It is precisely these secondary stickies which cause problems in the subsequent paper processing cycle. They are transported, for example, with the paper webs, pass through the papermaking machine and thus reach various places where they can cause unwanted deposits, particularly at pressing felts, drying wires, drying cylinders, smoothing rollers. In addition, they do of course also find their way into the finished paper and adversely affect its quality.

Accordingly, it is clear from the foregoing observations that, in principle, any parameters which promote the agglomeration of particles bring with them the danger of formation of secondary stickies. The pH value and the presence of certain papermaking auxiliaries are mentioned as two very important parameters in this regard. More specifically:

Small solid particles in contact with one another or separated from one another by only a very small space attach to one another under the effect of molecular interactions, so-called Van der Waals forces. In general, however, the agglomeration-promoting Van der Waals forces are not developed in alkaline medium, i.e. in the medium typical of wastepaper recovery, because the particles are surrounded by an electrical double layer which is responsible for mutual repulsion of the particles of like charge. By contrast, papermaking machines are normally operated in a neutral or mildly acidic environment so that the repelling negative forces are reduced.

The drainage capacity of paper stock suspensions produced from wastepaper is generally poor. Accordingly, auxiliaries known as drainage or retention agents are frequently used in practice. Retention agents are understood by the expert to be substances which bind fine fibers and fillers to the long paper stock fibers (long fibers). This binding of the short fibers and fillers to the long fibers prevents the fine materials from forming a kind of fleece which complicates drainage of the paper stock suspension. Accordingly, retention agents improve the drainage capacity by binding the fine fibers to the long fibers.

Retention agents can be divided into three groups, namely: inorganic products, such as aluminum sulfate or sodium aluminate; synthetic products, such as polyethylene imines, polyamines or polyacrylamides; and modified natural products, such as cationic starch.

The mode of action of retention agents is based on the attachment of fine fibers and fillers to the paper fibers. An important mechanism in this regard is that polyelectrolytes of sufficient chain length can bridge the distance between two particles and, in this way, cause agglomeration. Thus, J. L. Hemmes et al. report that cationic polyelectrolytes, for example cationic starch, are suitable as trappers for anionic impurities (Wochenblatt für Papierfabrikation 1993, pages 163–170).

To sum up the situation, it may be said that, so far as experts are generally aware, a neutral or acidic medium on the one hand and the use of cationic auxiliaries on the other hand for drainage and retention displacement represent conditions which promote the agglomeration of particles. So far as the above-discussed problem of stickies is concerned, this means that the expert logically regards these conditions are beneficial to the formation of stickies.

Another key factor in the control of stickies is the temperature. The reason for this is that many adhesives belong to the thermoplastics (hotmelts) of which the tackiness increases with temperature.

In addition, the manifestation of the unwanted properties of stickies for the process of papermaking or processing is dependent on a number of parameters of which the detail is not yet sufficiently known (cf. H. L. Baumgarten, loc. cit., page V122, left-hand column). It is even possible that normally harmless impurities are converted into stickies through the cooperation of mechanical, chemical and thermal influences during the production process (cf. B. Brattka, Wochenblatt für Papierfabrikation 1990, pages 310 to 313).

Now, there are various known methods which represent attempts to counteract the manifestation of the negative properties of stickies for the process of papermaking. Particular significance is attributed in this regard to the principle of suppressing the deposition of stickies through the use of an auxiliary, so that the disruptions caused by the adhesive properties are reduced to a technically acceptable level. The processes based on this premise are referred to hereinafter as SDC processes ("stickies deposition control").

Thus, U.S. Pat. No. 4,923,566 describes a process in which stickies are controlled by urea.

According to the teaching of U.S. Pat. No. 3,081,219, stickies are controlled in the sulfite pulping of wood by the use of N-vinyl-2-pyrrolidone.

Attempts have also been made to control stickies by the addition of bentonites, diatomaceous earth and the like. This well known principle is based on the idea of introducing fine particles which are capable of binding stickies to their surface (cf. U.S. Pat. No. 3,081,219, column 1, lines 40 to 44). Another premise is based on the addition of sequestering agents, for example polyphosphates (cf. U.S. Pat. No. 3,081,219, column 1, lines 45 to 50). Finally, attempts have also been made to use various dispersants, for example the sodium salts of sulfonated formaldehyde/naphthalene condensates, although this gives rise to disadvantages at neutral pH values and leads to unwanted interactions with cationic auxiliaries (cf. U.S. Pat. No. 3,081,219, column 1, lines 51 to 58).

U.S. Pat. No. 4,744,865 describes an SDC process in which the coagulation of stickies is said to be reduced by methoxyfunctional polymers.

U.S. Pat. No. 4,871,424 relates to an SDC process using hydroxyfunctional polymers. However, only cellulose derivatives, such as hydroxypropyl methyl cellulose, and polyvinyl alcohol obtainable by hydrolysis or partial hydrolysis from polyvinyl acetate are specifically mentioned as polymers.

Finally, G. Galland and F. Julien Saint Amand report that primary acrylate stickies can be removed by flotation in alkaline medium and in the presence of soap (cf. EUR. Comm. Eur. Communities 14011, 1992, pages 235– 243). From its very nature, however, this principle cannot assist in solving the problems caused by secondary stickies.

DESCRIPTION OF THE INVENTION

In overall terms, the prior art in the field under discussion is very heterogeneous and a totally satisfactory process for controlling stickies has yet to be developed. H. L. Baumgarten's observation still applies, namely: "It is clear from a glance at the problems caused by stickies in wastepaper that, in addition to manufacturers of wastepaper recovery plants, manufacturers of paper finishing and paper processing auxiliaries, which generally contain plastics, and the chemical industry as their supplier of raw materials have a responsibility to provide the paper industry with proper assistance" (Das Papist, 1984, No. 10A, page V124). Accordingly, there is a constant need for new or alternative solutions to the problem of controlling stickies in papermaking.

Accordingly, the problem addressed by the present invention was to provide a process for controlling the deposition of stickies in papermaking which would avoid the disadvantages of the prior art. This process would be generally applicable to the various types of stickies, but especially to pressure-sensitive adhesives, dispersion adhesives and hotmelts. In addition, the auxiliaries to be used in this process would be biologically safe and, accordingly, would satisfy ecological requirements which are now becoming increasingly important in the paper-processing industry. Finally, the problem addressed by the present invention would encompass in particular the problems presented by secondary stickies.

According to the invention, this problem has been solved by a process for controlling the deposition of stickies from paper stock suspensions in papermaking, in which an effective quantity of a degradation product of native starch is added to the paper stock suspension.

Accordingly, the present invention relates to a process for controlling the deposition of stickies from paper stock suspensions in papermaking, characterized in that an effective quantity of a degradation product of native starch is added to the paper stock suspension.

In the context of the present invention, degradation products of native starch are understood to be products which may be obtained by thermal, hydrolytic or enzymatic degradation of native starch and which have a lower average molecular weight than the basic native starch and a higher average molecular weight than glucose, the product of complete degradation. However, it is specifically pointed out that the products of a chemical derivatization, such as esterification, etherification, acetylation, etc., are not encompassed by the definition used herein of the degradation products of native starch.

According to the invention, degradation products of native starch which have an average molecular weight of 1,200 to 600,000 are preferred. These products are preferably produced by acidic hydrolysis or enzymatic hydrolysis or by a combination of these methods.

Basically, there is no particular limitation to the type of native starch which is used to produce the degradation products suitable in accordance with the invention. For example, potato starch, cornstarch, rice starch or canna starch may be used as starting materials. However, degradation products of potato starch are preferably used.

The process according to the invention may be generally applied to various types of stickies. However, it is particularly suitable for solving the problems caused by pressure-sensitive adhesives, dispersion adhesives and hotmelts.

In one preferred embodiment, the process according to the invention is applied to paper stock suspensions produced from wastepaper or from paper products containing wastepaper constituents.

It has also been found that the effect of the degradation products of native starch suitable in accordance with the invention can be improved by carrying out the process in the presence of a cellulose derivative. Carboxymethyl cellulose, methylhydroxypropyl cellulose and mixtures thereof are particularly preferred cellulose derivatives.

The present invention also relates to the use of degradation products of native starch for controlling the deposition of stickies from paper stock suspensions in papermaking.

In principle, the process according to the invention is suitable for controlling the deposition and adhesion of stickies of various kinds and, hence, of different chemical and physicochemical characteristics. However, the process according to the invention may be used with particular advantage for controlling stickies based on pressure-sensitive adhesives and hotmelts.

Basically, the degradation products of native starch according to the invention may be added at any point of the papermaking process as a whole. They are added either in the form of solid particles or in the form of an aqueous solution or dispersion. The particular effective quantity of native starch required depends on the extent to which stickies are present in the wastepapers or papers containing wastepaper constituents which are to be processed. In general, however, the degradation products of native starch according to the invention are used in a quantity of 0.001 to 5.0% by weight and preferably in a quantity of 0.1 to 1.0% by weight, based on the paper stock.

The following Examples are intended to illustrate the invention without limiting it in any way.

EXAMPLES

1. Substances and materials used 1.1. Polymers a) MHPC: Methylhydroxypropyl cellulose (MHPC 50, a product of Aqualon)

b) DPS: Degraded potato starch (Noredux 118, a product of Henkel KGaA).

1.2 Pressure-sensitive adhesives a) Styrene/butadiene b) Vinyl ester c) Acrylate 2. Denaturing tests 2.1. Principle of the method The denaturing test applied here is already known in principle to the expert from U.S. Pat. No. 4,886,575 and from the above-cited article by B. Brattka (loc. cit., page 311). The method comprises immersing a selected adhesive tape in an aqueous solution containing the substance to be tested. The tapes are then stuck together under defined conditions, after which the adhesive force (still present) is determined in a universal testing machine.

2.2. Details of the test procedure

Quantities of 200 ml solution of various polymers were prepared and poured into 200 ml glass beakers. Various adhesive tapes were immersed in the solutions for exactly 30 seconds. The tapes were then dried for 4 hours at a temperature of 23°±1° C. Two tapes treated in the same way were then stuck together. The contact pressure was kept at a constant value of $1N/mm^2$ by a press. The adhesive strips open at one end through the insertion of two release papers were fixed in a universal testing machine and peeled from one another at a rate of 250 mm/min. (similarly to DIN 53 282 "Angular Peel Test"). The peel forces determined in dependence upon the selected concentration of the polymers are set out in the following Tables. The peel force may be regarded as an indicator of the ability of the particular polymer to exert a controlling influence on the formation of stickies. The lower the force measured, the more effectively the polymer prevents sticking of the tapes to one another and, hence, the agglomeration of adhesive particles which ultimately cause the stickies problem. The values shown in the Tables are average values of five measurements.

| Comparison test 1<br>Polymer tested: MHPC | | | |
|---|---|---|---|
| Polymer | Peel strength (N/cm) for | | |
| concentration (% by weight) | Styrene/ butadiene | Vinyl ester | Acrylate |
| 0 | 3.6 | 2.9 | 2.5 |
| 0.5 | 1.3 | 1.1 | 1.2 |
| 1.0 | 1.0 | 0.9 | 1.0 |
| 2.0 | 0.8 | 0.8 | 0.9 |

| Example 1<br>Polymer tested: DPS | | | |
|---|---|---|---|
| Polymer | Peel strength (N/cm) for | | |
| concentration (% by weight) | Styrene/ butadiene | Vinyl ester | Acrylate |
| 0 | 3.6 | 2.9 | 2.5 |
| 0.5 | 1.0 | 1.1 | 0.8 |
| 1.0 | 0.7 | 0.8 | 0.7 |
| 2.0 | 0.7 | 0.6 | 0.7 |

2.3. Discussion of the results

It is clear from the above Tables that better results are obtained with the degradation products of native starches according to the invention than with MHPC which is structurally the most closely related native polymer known from the prior art.

The advantages achieved with the products according to the invention were not foreseeable in their extent and clearly show that modified starches behave quite differently from modified celluloses.

3. Application Example

A three week practical test was carried out in a papermaking factory producing tissue paper from 100% wastepaper. A 5% by weight solution of degraded potato starch (DPS, cf. Example 1) was introduced at a rate of 16 kg/hour. The papermaking machine produced 4,000 kg paper per hour. The number of holes in the paper web fell from an average of $0.2/m^2$ to $0.05/m^2$. At the same time, there was a reduction in the deposits on the wires and felts, so that the machine running times between cleaning intervals could be extended. The number of breaks fell from 4 per week to 2.

What is claimed is:

1. The process of controlling the deposition of stickies from paper stock suspensions during papermaking, consisting of adding to said paper stock suspensions an effective quantity of a degradation product of native starch having an average molecular weight of 1,200 to 6,000,000.

2. A process as in claim 1 wherein said paper stock suspensions are produced from wastepaper or paper products containing wastepaper.

3. A process as in claim 1 wherein said native starch is selected from the group consisting of potato starch, corn starch, rice starch and canna starch.

4. A process as in claim 1 wherein said degradation product of native starch is obtained by thermal, hydrolytic or enzymatic degradation of native starch.

5. A process as in claim 1 wherein said stickies are derived from pressure-sensitive adhesives, dispersion adhesives, and hotmelt adhesives.

6. A process as in claim 1 further including adding a cellulose derivative to said paper stock suspensions.

7. A process as in claim 6 wherein said cellulose derivative is selected from the group consisting of carboxymethyl cellulose, methylhydroxypropyl cellulose, and mixtures thereof.

8. The process of controlling the deposition of sticky soils from paper stock suspensions during papermaking, consisting of adding to said paper stock suspensions from 0.00 to 5.0% by weight of the degradation product of natural starch having an average molecular weight of 1,200 to 600,00, based on the weight of paper stock.

9. A process as in claim 8 wherein said paper stock suspensions are produced from wastepaper or paper products containing wastepaper.

10. A process as in claim 8 wherein said natural starch is selected from the group consisting of potato starch, corn starch, rice starch and canna starch.

11. A process as in claim 8 wherein said degradation product of natural starch is obtained by thermal, hydrolytic or enzymatic degradation of natural starch.

12. A process as in claim 8 wherein said sticky soils are derived from pressure-sensitive adhesives, dispersion adhesives, and hotmelt adhesives.

13. A process as in claim 8 further including adding a cellulose derivative to said paper stock suspensions.

14. A process as in claim 13 wherein said cellulose derivative is selected from the group consisting of carboxymethyl cellulose, methylhydroxypropyl cellulose, and mixtures thereof.

* * * * *